US009199699B1

(12) United States Patent
Anderson

(10) Patent No.: US 9,199,699 B1
(45) Date of Patent: Dec. 1, 2015

(54) HULL-MOUNT LAUNCH AND RECOVERY OF WATERCRAFT

(71) Applicant: The United States of America, as represented by the Secretary of the Navy, Washington, DC (US)

(72) Inventor: Steven E. Anderson, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 463 days.

(21) Appl. No.: 13/762,761

(22) Filed: Feb. 8, 2013

(51) Int. Cl.

| | |
|---|---|
| ***B63B 23/32*** | (2006.01) |
| ***B63B 23/00*** | (2006.01) |
| ***B63B 23/18*** | (2006.01) |
| ***B63B 23/04*** | (2006.01) |

(52) U.S. Cl.
CPC ..... *B63B 23/32* (2013.01); *B63B 23/04* (2013.01); *B63B 23/18* (2013.01)

(58) Field of Classification Search
CPC .... B63B 23/04; B63B 2712/02; B63B 23/32; B63B 23/18; B63B 23/06; B63B 2027/165
USPC ..... 114/364, 366, 372, 373, 374, 258, 259
See application file for complete search history.

(56) References Cited

U.S. PATENT DOCUMENTS

| | | | | |
|---|---|---|---|---|
| 3,326,161 | A * | 6/1967 | Johns | 414/679 |
| 3,834,338 | A * | 9/1974 | Renouf | 414/679 |
| 3,993,011 | A * | 11/1976 | Garland | 414/137.7 |
| 5,113,782 | A * | 5/1992 | McCarty | 114/362 |
| 5,544,606 | A * | 8/1996 | Schmidt, Jr. | 114/48 |
| 6,003,463 | A * | 12/1999 | Giesler | 114/259 |
| 8,096,254 | B1 * | 1/2012 | Bauer et al. | 114/259 |
| 8,205,568 | B2 * | 6/2012 | Braun | 114/268 |
| 2008/0105186 | A1 * | 5/2008 | Johns et al. | 114/259 |
| 2013/0014686 | A1 * | 1/2013 | Alden et al. | 114/259 |

* cited by examiner

*Primary Examiner* — Anthony Wiest
(74) *Attorney, Agent, or Firm* — Gerhard W. Thielman, Esq

(57) ABSTRACT

An apparatus is provided for stowing, launching and recovering an unmanned surface vehicle (USV) on a boat bull, such as applicable to a small unit riverine craft (SURC) in water. The apparatus includes a frame for removably attaching to the hull, a lifter, a hinge, and a boom. The frame includes lateral brackets connected together by transverse braces, and attaches to the hull at cushions. The lifter connects to the frame for elevating the USV between upper and lower positions. The hinge connects to the lifter for pivoting the USV between vertical and horizontal orientations. The boom connects to the hinge for docking and releasing the USV. The USV is stowed in the vertical orientation and the upper position. The USV deploys into the water in the horizontal orientation and the lower position.

8 Claims, 11 Drawing Sheets

HULL-MOUNT LAUNCH AND RECOVERY OF WATERCRAFT

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to mechanisms that can be attached on a small unit riverine craft (SURC) for stowing and launching at least one unmanned surface vehicle (USV).

The United States Navy operates SURC in rivers for close-in fire support on inland waterway missions. SURC is rigid-hull, armed and armored patrol boat used by the U.S. Marine Corps and the U.S. Navy to maintain control of rivers and inland waterways. They are similar in size and purpose to the earlier Patrol Boat. The primary mission of the SURC is to provide tactical mobility and a limited weapons platform for the ground combat element of a Marine Air Ground Task Force in littoral and riverine environments.

The USV constitutes to any vessel that operates on the surface of the water without a crew. USVs encompass both military and academic oceanographic applications, and offer lower cost alternatives to manned craft while minimizing potential risks to human life. USVs are reliable, fast, highly maneuverable, enabling them to conduct a wide range of missions, including patrols of the coast, without endangering human life. The operation of USVs has been tested since the second World War and have gained in acceptance since deployment in the Afghani operations.

SUMMARY

Conventional stowage and deployment configurations and procedures yield disadvantages addressed by various exemplary embodiments of the present invention. In particular, various exemplary embodiments provide an apparatus for stowing, launching and recovering an unmanned surface vehicle (USV) on a boat bull, such as applicable to a small unit riverine craft (SURC) in water. The apparatus includes a frame for removably attaching to the hull, a lifter, a hinge, and a boom. In various exemplary embodiments, the lifter connects to the frame for elevating the USV between upper and lower positions. The hinge connects to the lifter for pivoting the USV between vertical and horizontal orientations. The boom connects to the hinge for docking and releasing the USV.

The USV is stowed in the vertical orientation and the upper position. The USV deploys into the water in the horizontal orientation and the lower position. In various exemplary embodiments, the frame includes lateral brackets connected together by transverse braces, and attaches to the hull at cushions. In various exemplary embodiments, the lifter elevates the hinge into the upper position when said boom is in the vertical orientation.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

Figure 1:
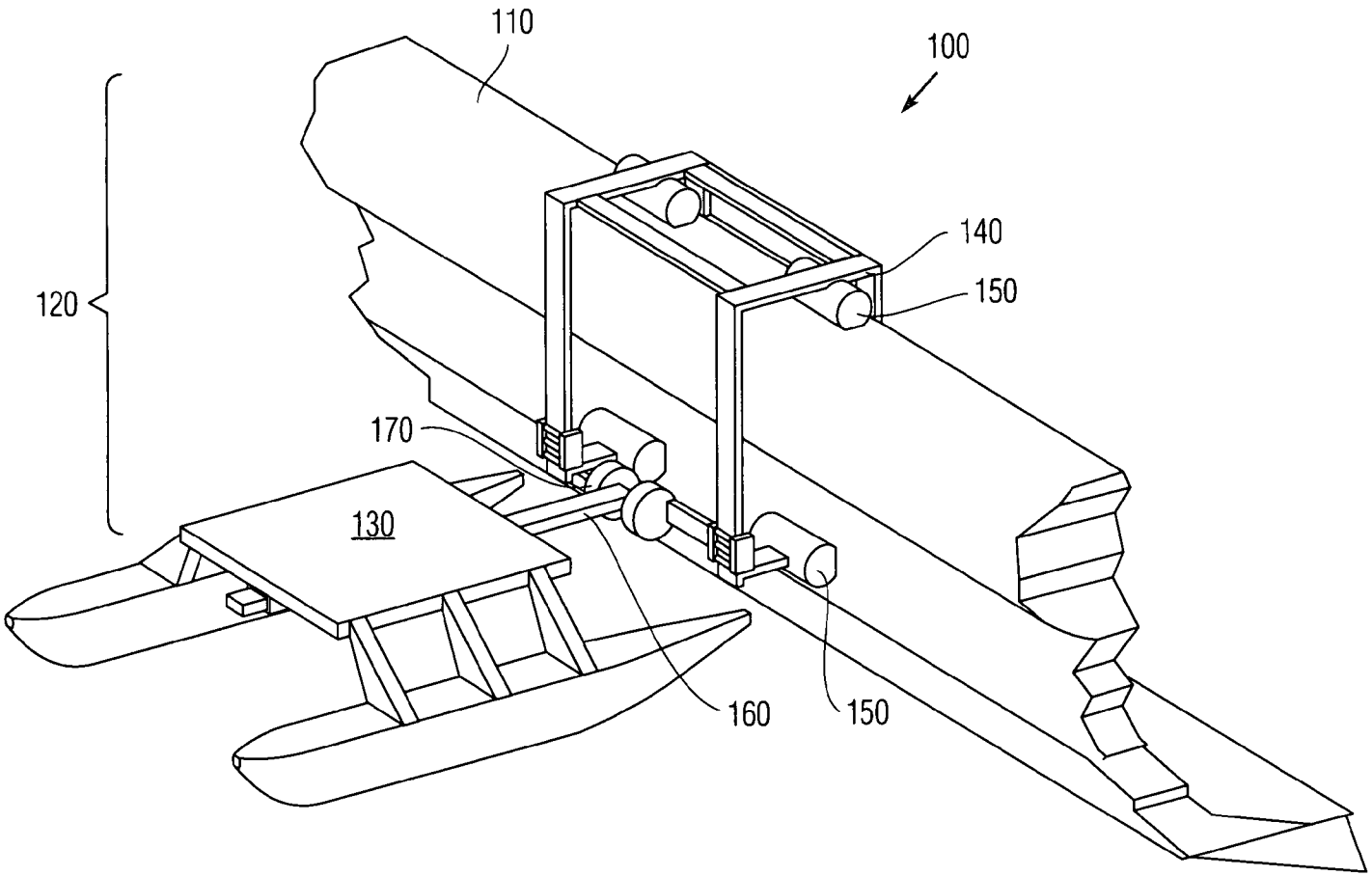
FIG. 1 is a perspective cutaway view of an exemplary launch and recovery system.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

An artisan of ordinary skill will readily appreciate that alternate but functionally equivalent means of launch and recovery of an USV are available. The inclusion of additional elements may be deemed readily apparent and obvious to an artisan of ordinary skill. Specific elements disclosed herein are not to be interpreted as limiting, but rather as a basis for the claims and as a representative basis for teaching employment of the present invention.

The drawings are not necessarily to scale; instead, emphasis has been placed upon illustrating the principles of exemplary embodiments. In addition, in the embodiments depicted herein, like reference numerals in the various drawings refer to identical or near identical structural elements. Moreover, the terms "substantially" or "approximately" as used herein may be applied to modify any quantitative representation that could permissibly vary without resulting in a change in the basic function to which that quantity is related.

A prototype USV of about 75 lbm has been tested for maneuvers. This USV has been developed by Aerospace Development Laboratory (ASDL) at Georgia Institute of Technology and is sponsored by ONR Code 333 to explore concepts of deployment on boats such as the SURC. Maintaining the USV when not being used represents a challenge satisfied by exemplary embodiments that provide an automated launch and recovery system.

FIG. 1 shows a perspective view 100 of an exemplary launch and recovery system. A cutaway SURC hull 110 includes an externally detachable mount 120 for stowage, launch and recovery of a USV 130. The SURC 110 has a length of 38 ft, a beam of 10 ft, a displacement of about 11 tons and an operations range of about 250 nautical miles. The temporary mount 120 includes a frame 140 with cushions 150 at positions touching the hull of the SURC 110. The mount 120 also includes a boom 160 and a hinge 170.

Figure 2:
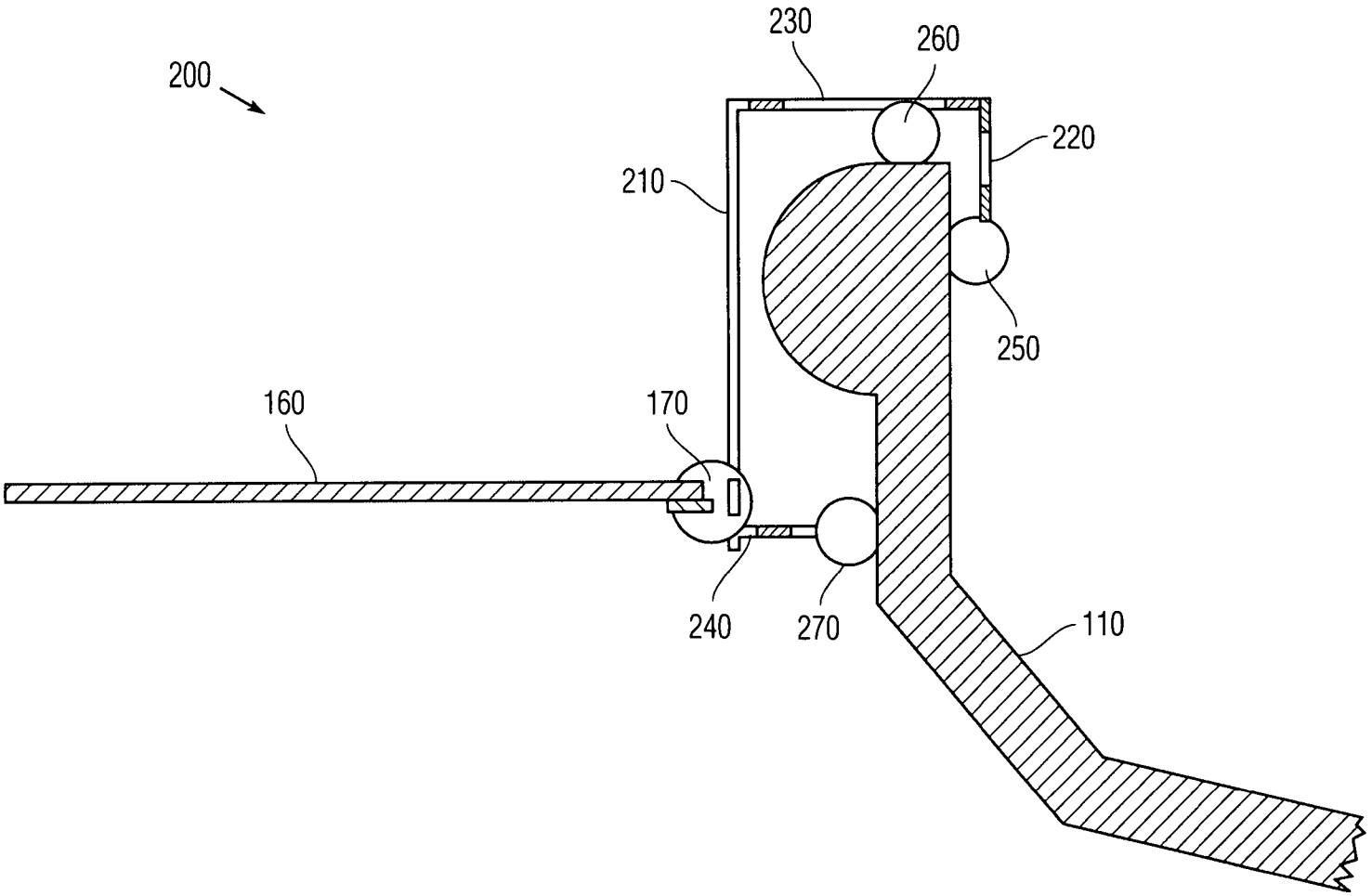
FIG. 2 is an elevation view of the launch and recovery system.

FIG. 2 shows an elevation view 200 of the launch and recovery system. The frame 140 for the mount 120 includes laterally parallel rail brackets 210, each having an inboard brace 220, an upper brace 230 and bottom brace 240, with the braces being transverse to the brackets 210. The cushions 150 constitute parallel sets of an inboard cushion 250, an upper cushion 260 and a bottom cushion 270 intended to prevent damage to the SURC hull 110. The mount 120 can be installed to the side (port and/or starboard) or the stem of the SURC hull 110 and subsequently removed. The mount 120 can be in multiple units on the same SURC 110 at several locations on the hull, depending upon craft configuration of inboard or outboard motors.

The mount 120 includes mechanisms to enable rapid deployment and recovery of multiple USVs from a single watercraft, currently in inventory and used by the Naval Expeditionary Combat Command that satisfy the following criteria:

minimal/no impact upon the physical structure of the host craft;

minimal/no impact upon current craft configuration, storage, seating, usable space or operations;

easily and quickly installed and removed;

operable by a single operator with little or no training;

highly rugged and reliable;

corrosion resistant;

configurable to enable multiple USVs to launched or recovered concurrently or sequentially;

enables side mountable or aft mountable configurations;

non-destructive non-interfering temporary structure (side mounted or aft mounted) to quickly, reliably and affordably launch and recover USVs between 25 lbs and 500+ lbs in weight; and enables standardization of size, length, width characteristics of the mount 120, as well as locking mechanisms, launching and docking software.

Figure 3A:
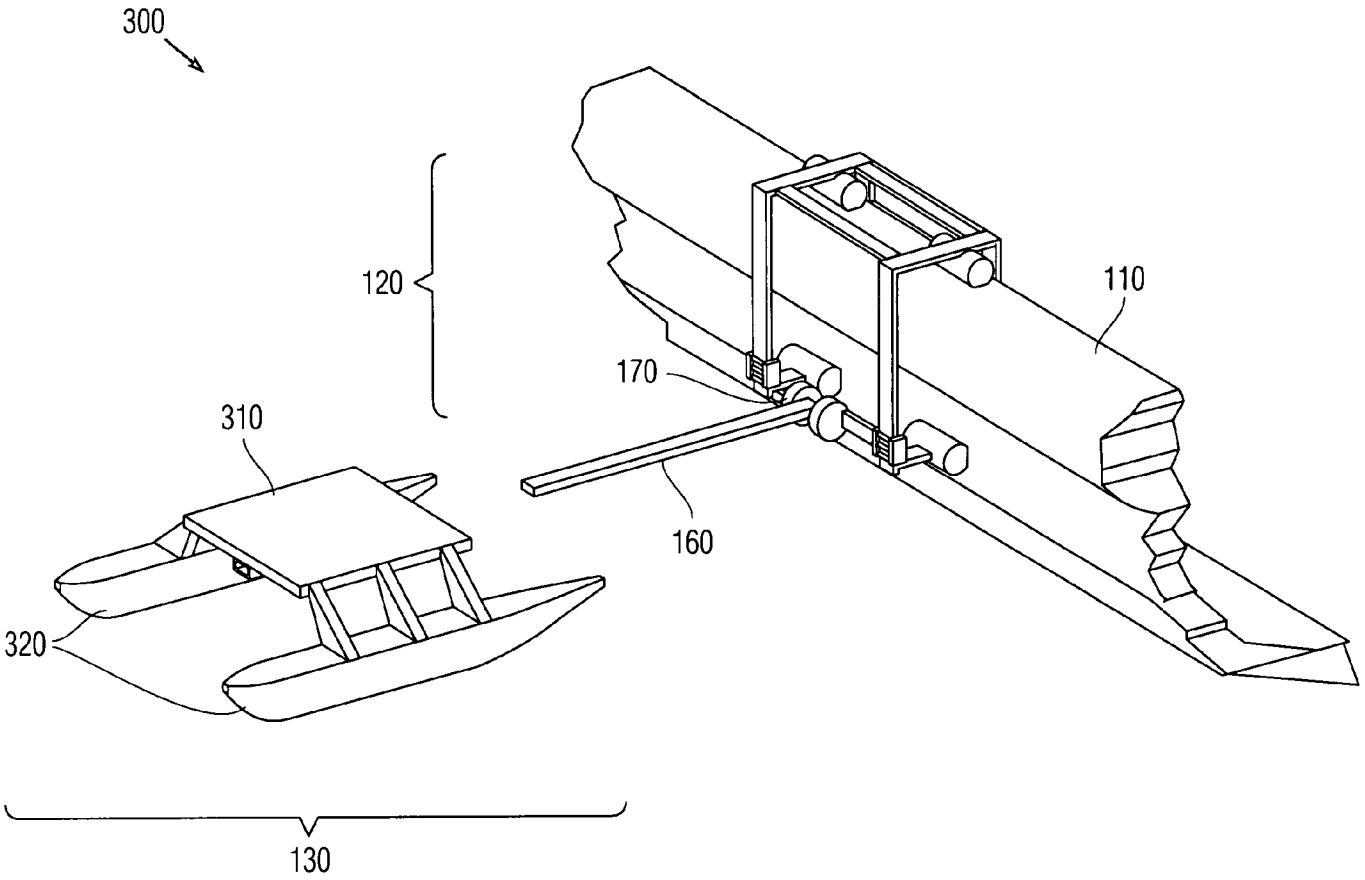
FIG. 3A through 3E are perspective cutaway views of the launch and recovery system in operational modes.
Figure 3B:
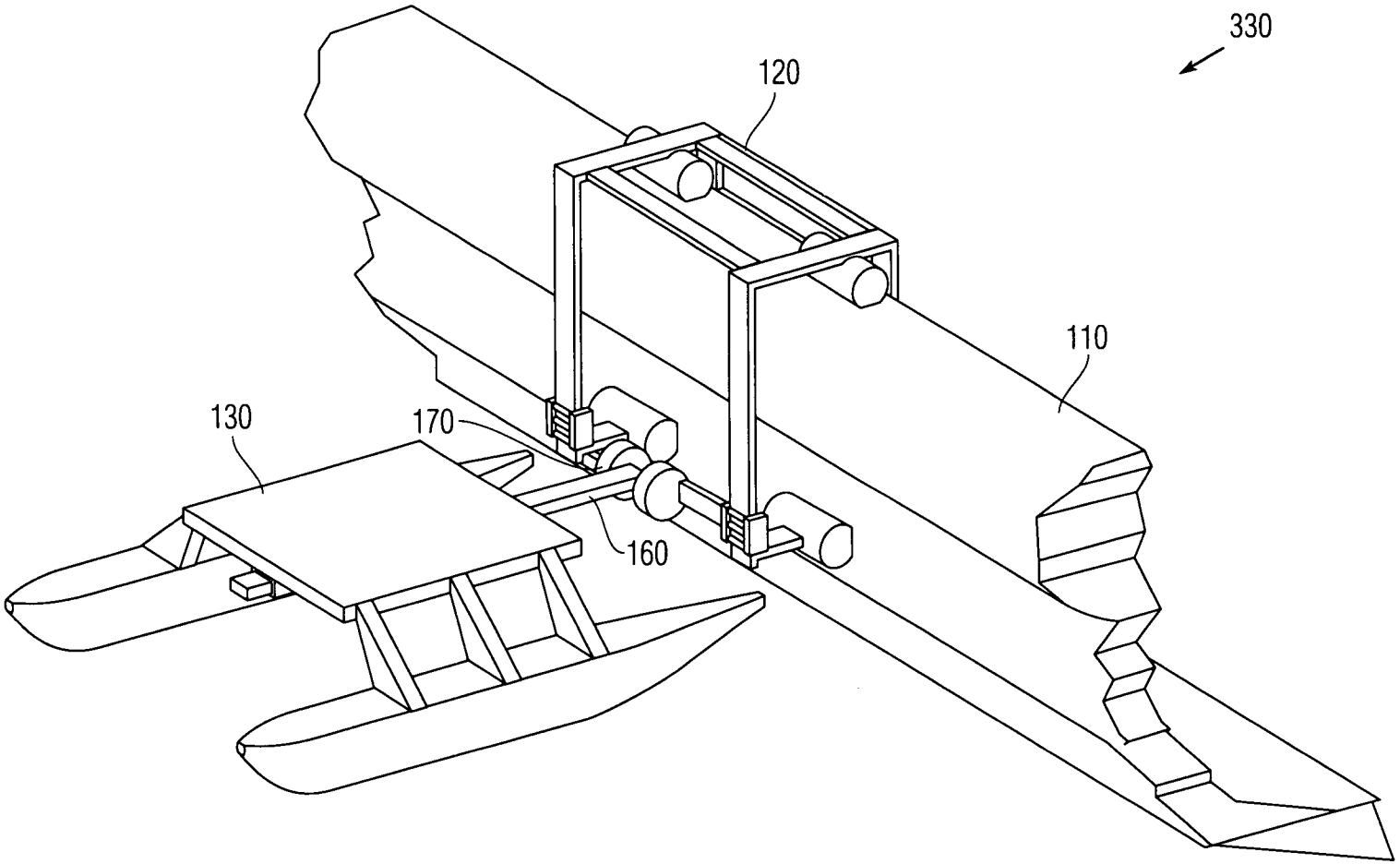

FIGS. 3A through 3E show perspective views of the launch and recovery system in stages of operation. FIG. 3A shows a perspective view 300 with the SURC 110 on the water with the mount 120, and the USV 130 approaching the boom 160 and its hinge 170. The boom 160 can be shaped as a wide beam that includes a v-shape notch, to which a protrusion on the USV 130 could align while approaching the SURC 110. The exemplary USV 130 includes a platform 310 (that can include a propulsion motor and navigation system) floating on pontoons 320. FIG. 3B shows a perspective view 330 with the SURC 110 and the USV 130, both on the water, having docked to the boom 160 in the horizontal position.

Figure 3C:
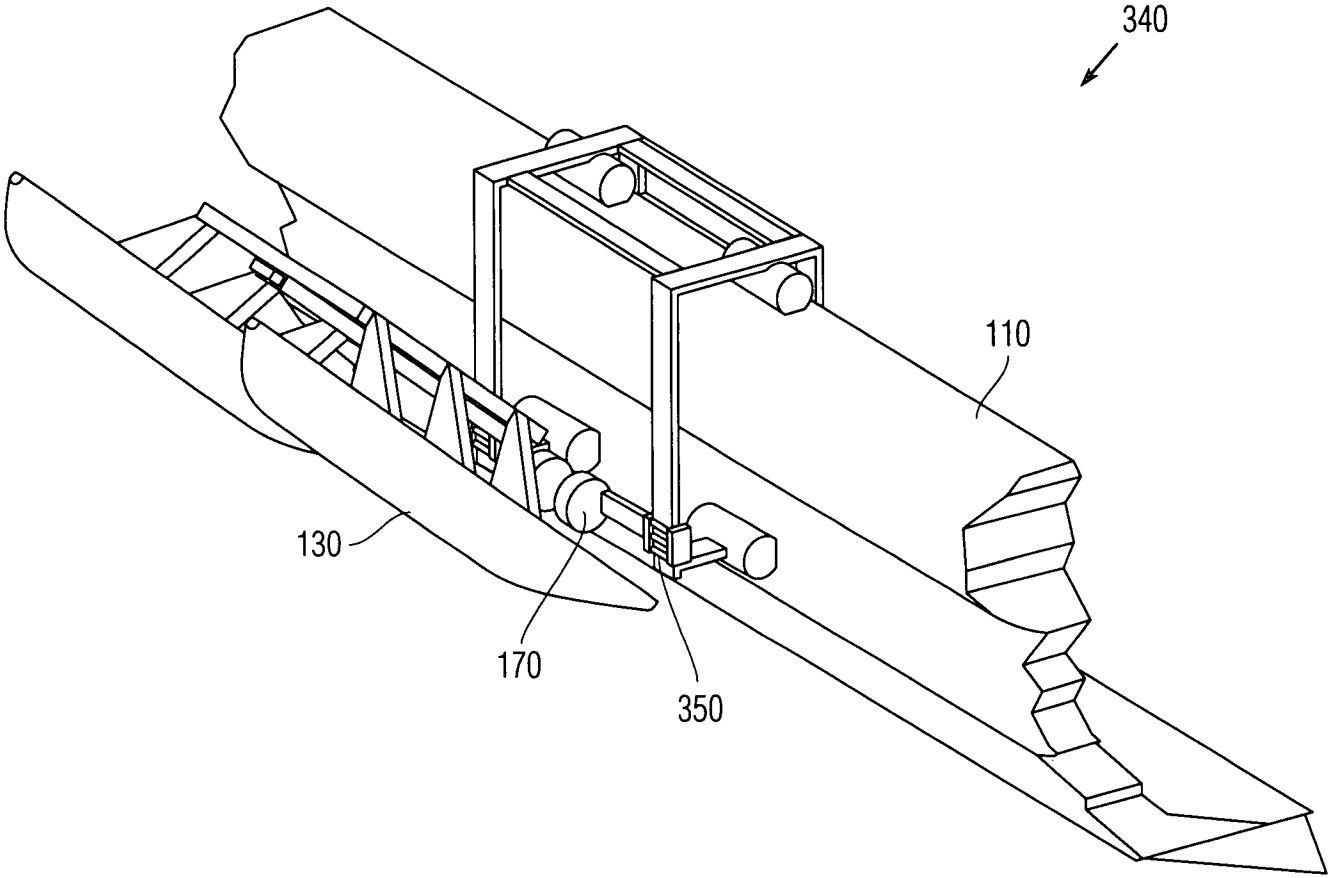

FIG. 3C shows a perspective view 340 with the SURC 110 as well as the USV 130 being rotated out of the water on the boom 160 by the hinge 170. A ratcheting lift mechanism 350 on each rail bracket 210 of the frame 140 and suspended between the rail brackets 210 is used to elevate the upright USV 130 once docked on the boom 160. The lift mechanism 350 can alternatively raise and lower the hinge 170 and boom 160 for the purpose of deploying or stowing the USV 130. The lift mechanism 350 and the hinge 170 can be powered by a motor, or else manually. The USV 130 can be locked in the stowed position.

Figure 3E:
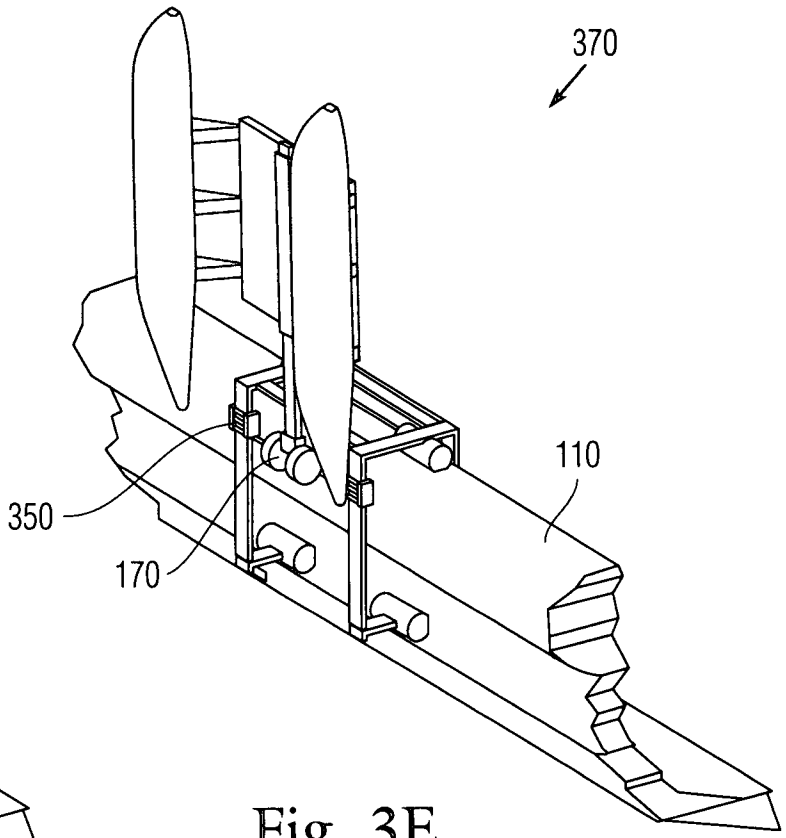
Figure 3D:
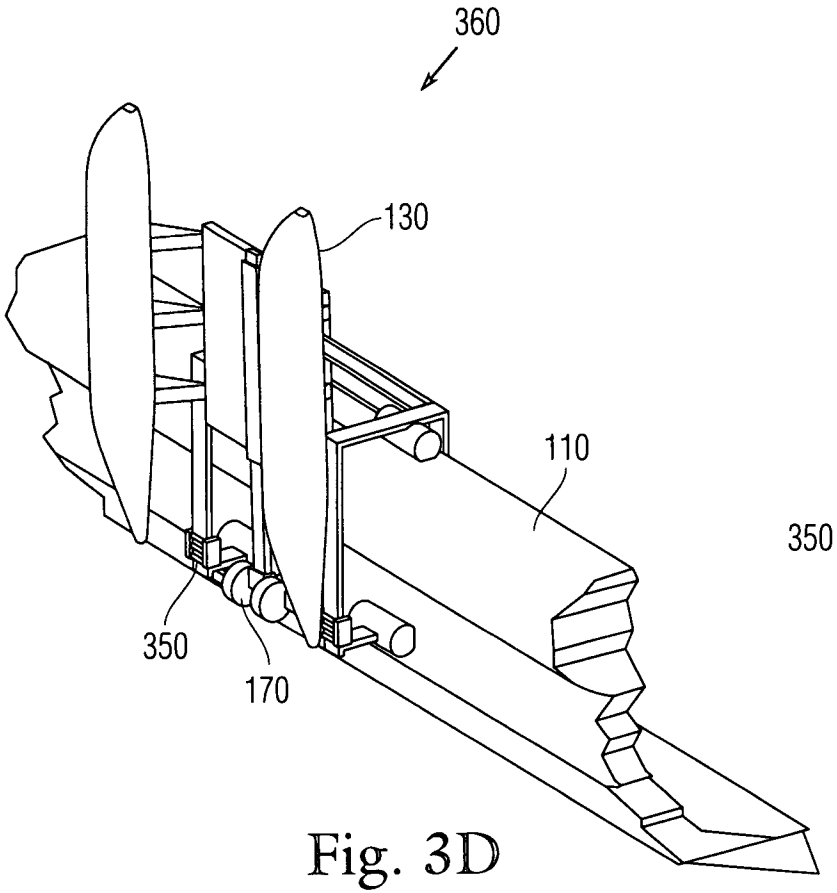

FIG. 3D shows a perspective view 360 with the SURC 110, along the USV 130 rotated to the vertical position and the lift 350 at the bottom of the rails 210. FIG. 3E shows a perspective view 370 with the SURC 110 and the USV 130 having been raised in the vertical position and the lift 350 at the top of the rail brackets 210. The width between the elongated sections of the rail brackets 210 matches the width of the platform 310 of the USV 130, thereby facilitating a compact fit when the USV 130 is in its upright and locked position, preventing from rubbing against the brackets 210.

Figure 4A:
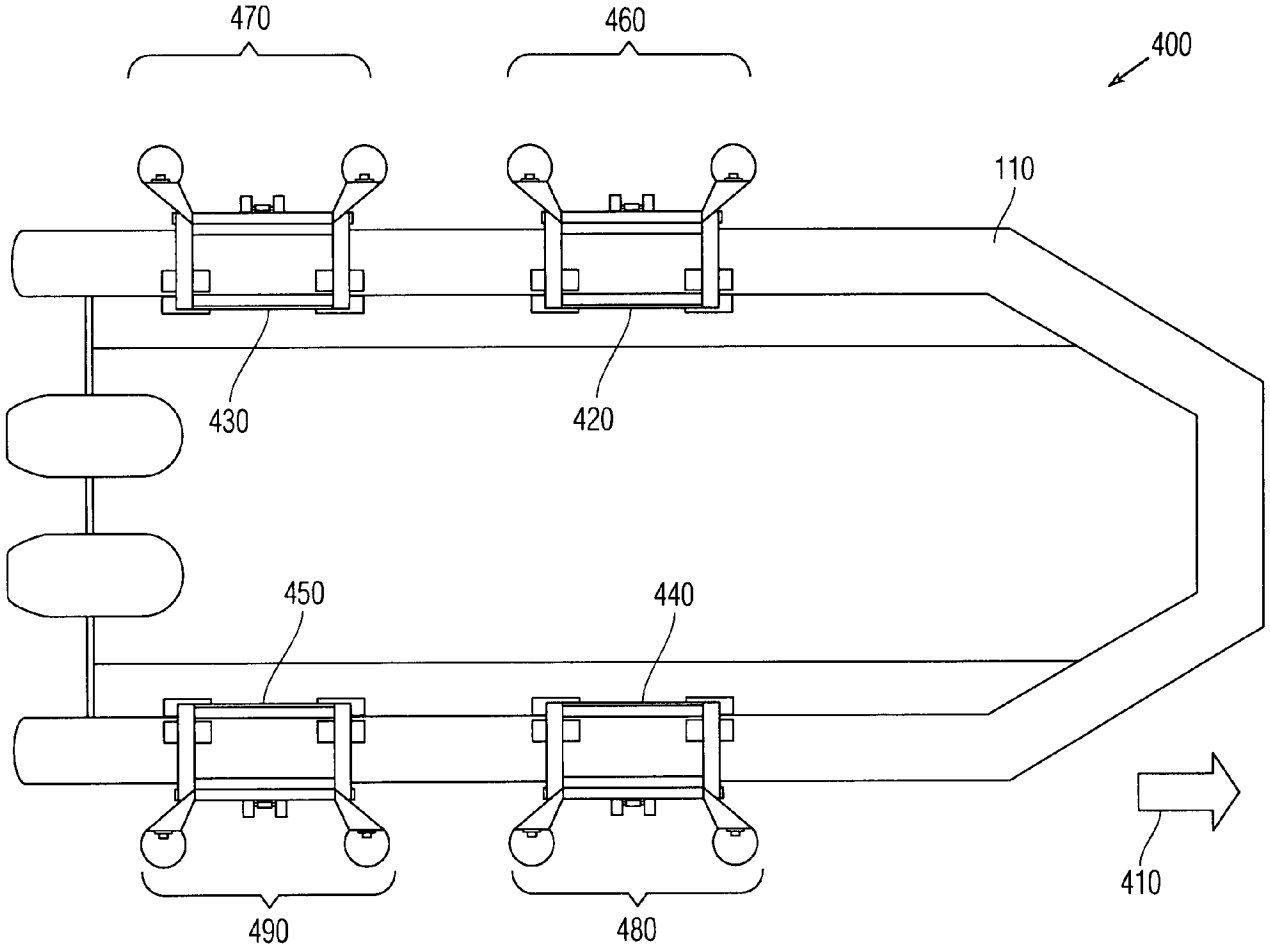
FIGS. 4A and 4B are plan views of an installation craft with multiple the launch and recovery systems.
Figure 4B:
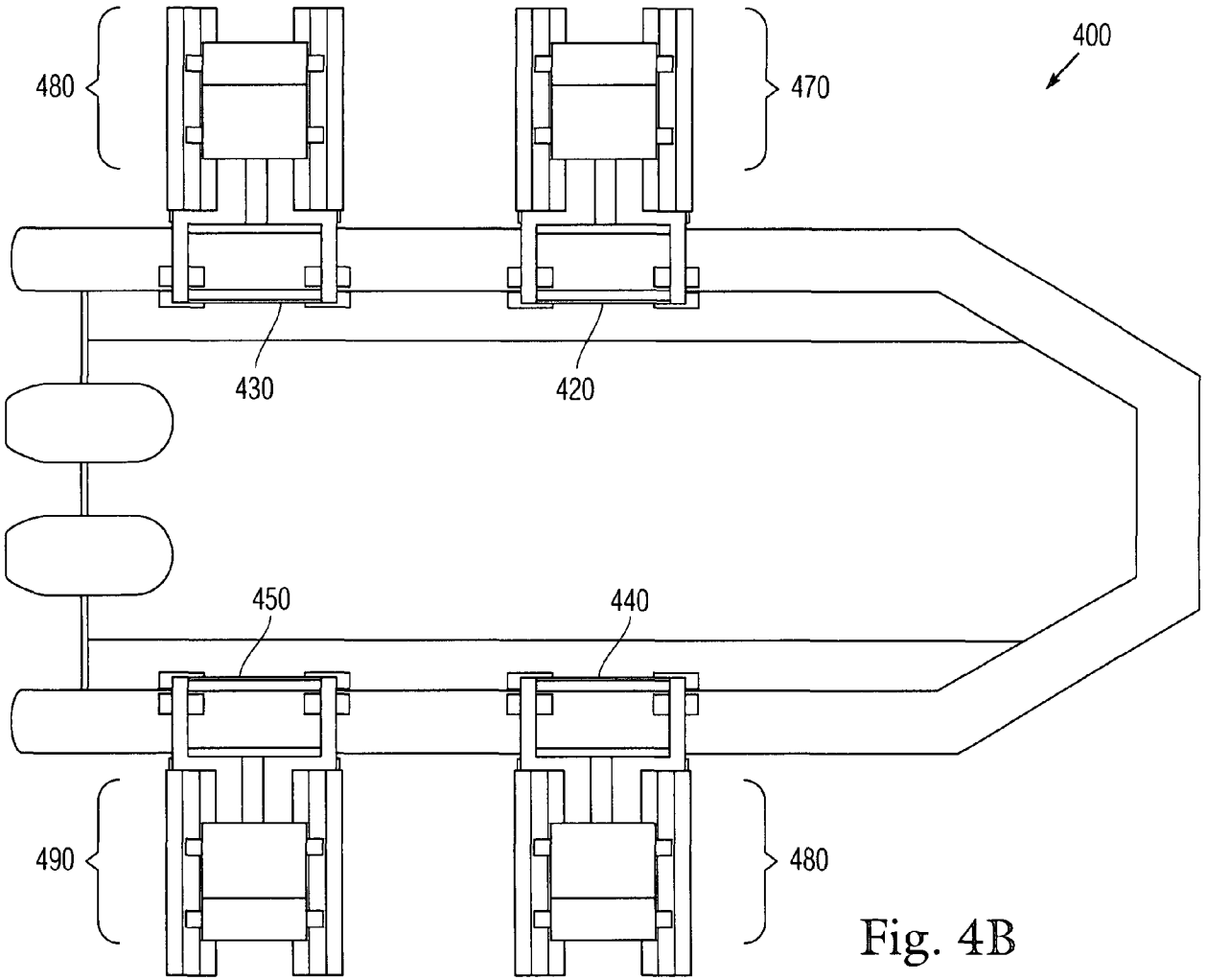

FIGS. 4A and 4B show plan views 400 of the SURC 110 with four mounts 120 accompanied by four USVs 130. FIG. 4A shows the SURC 110 with an arrow 410 indicating a reference direction towards the bow. The port side includes fore and aft mounts 420 and 430. The starboard side includes fore and aft mounts 440 and 450. The mounts 420, 430, 450 and 460 respectively stows USVs 460, 470, 480 and 490 in the upright vertical position, as shown in view 370. FIG. 4B shows the SURC 110 with the USVs 460, 470, 480 and 490 lowered in the deployment horizontal position at their respective mounts 420, 430, 450 and 460, as shown in view 330.

Figure 5B:
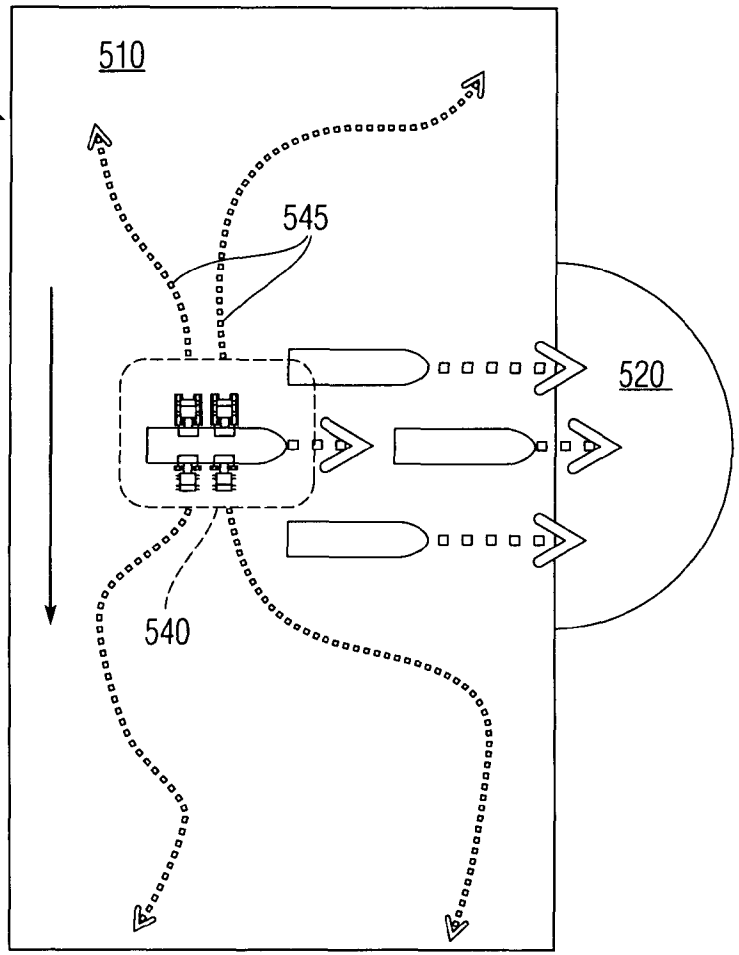
FIG. 5A through 5E are plan views of a mission scenario with several craft and multiple USVs.
Figure 5A:
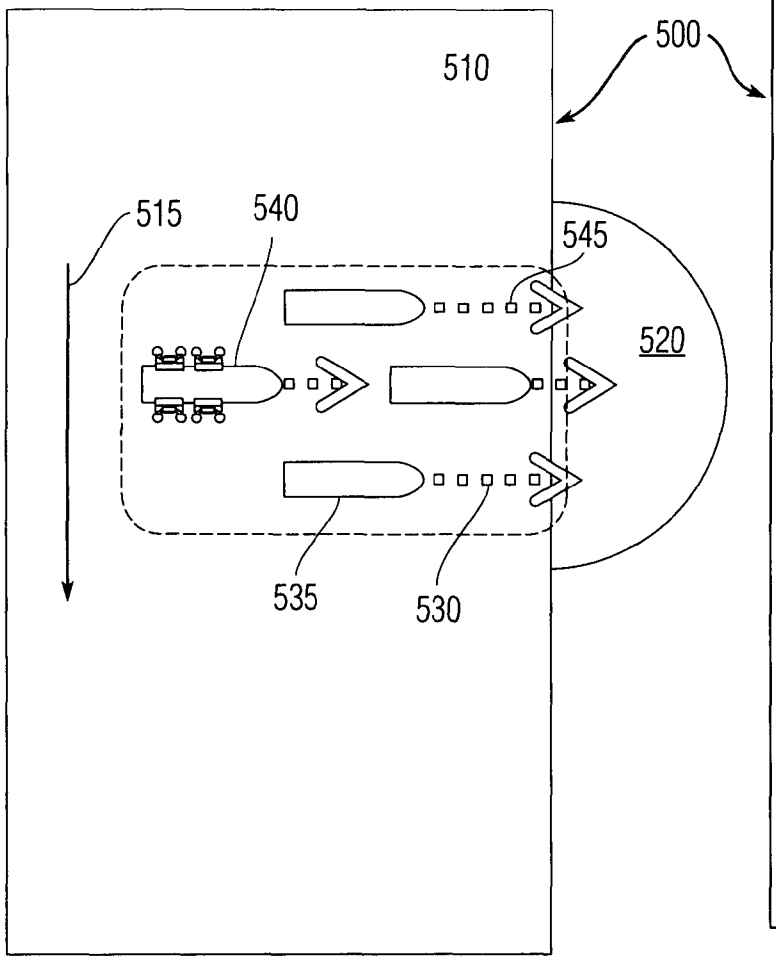

FIGS. 5A through 5E show plan views 500 of SURCs 110 on an operation with USVs 130. The views 500 show a river 510 flowing with a current in direction 515 with an amphibious deployment mission on land 520. FIG. 5A depicts a squadron 530 of four SURCs 110, including a designated SURC 540 equipped with the deployment systems 120 with the USVs 130 stowed as in view 370, approaches the land 520 in direction 545.

Figure 5D:
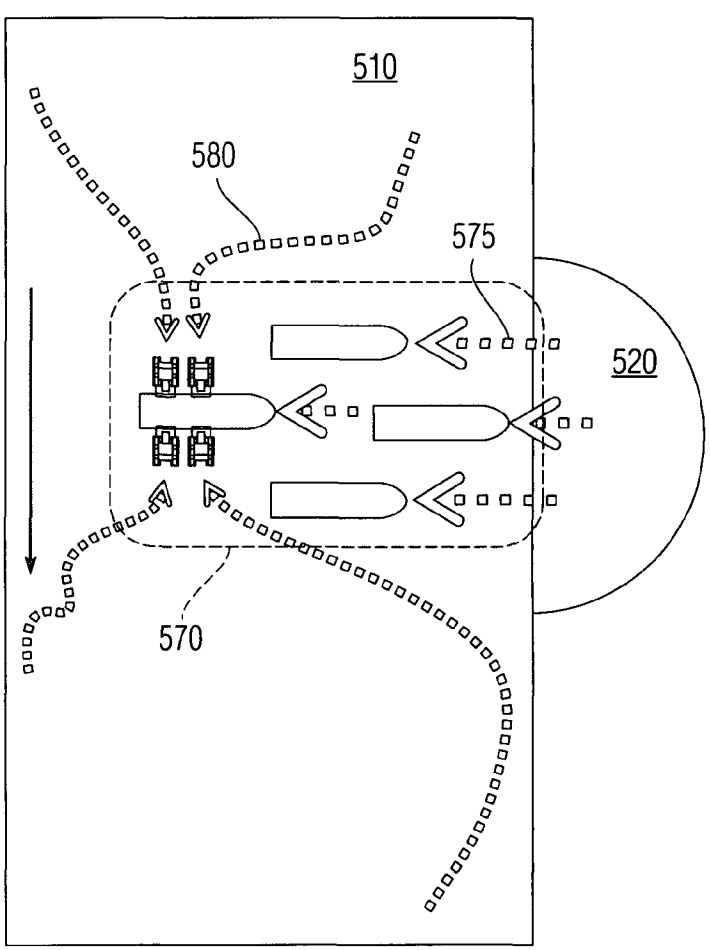
Figure 5C:
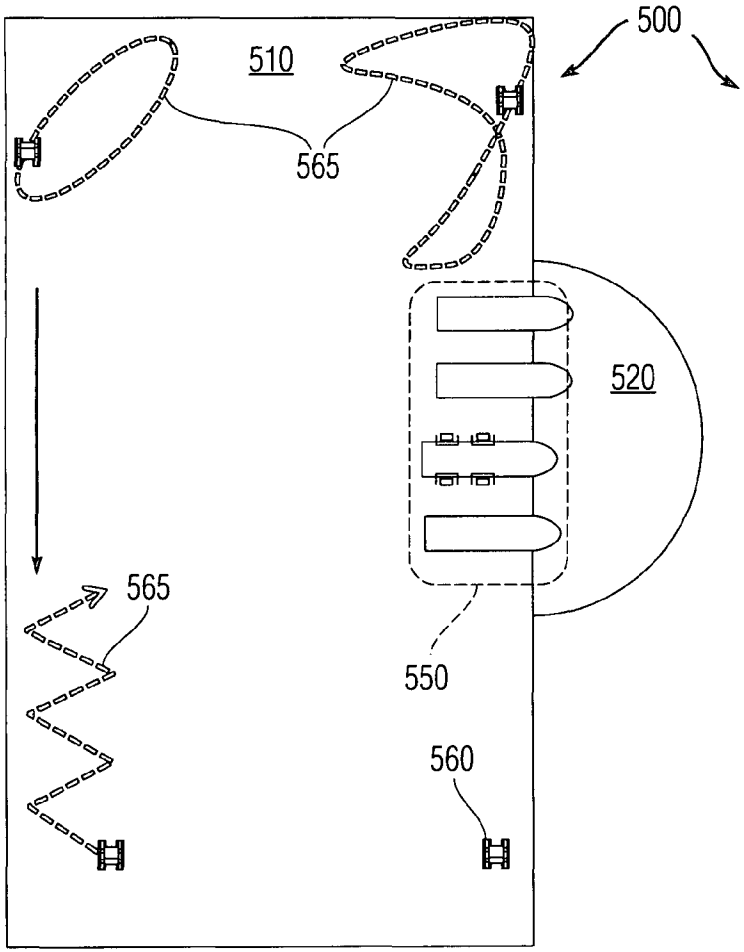
Figure 5E:
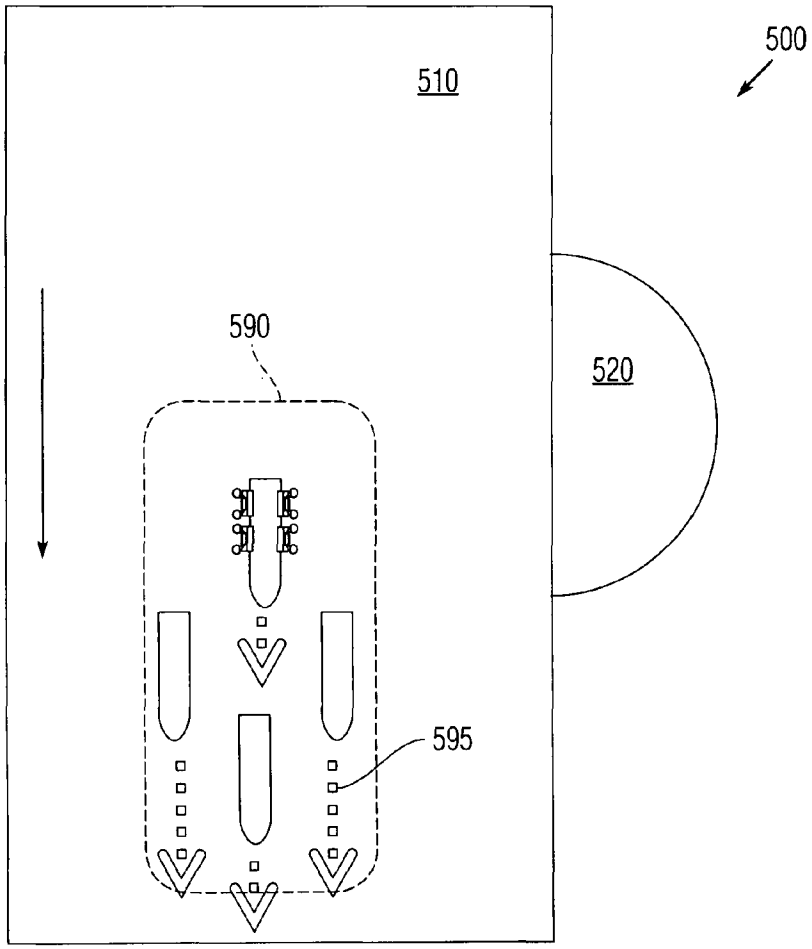

FIG. 5B shows the equipped SURC 540 having lowered the USVs 130 for deployment as in view 330. The USVs 130 are programmed to travel away from the squadron 530 along paths 545 for reconnaissance or other support roles. FIG. 5C shows the beached SURCs 540 and the deployed USVs 560 on station according to their patrol routes 565. FIG. 5D shows the squadron 570 after vacating from the land 520 along directions 575 and the USVs 560 returning along return trajectories 580. FIG. 5E shows the SURC squadron 590 after recovery of the USVs 560 and steaming downstream the river 510 along paths 595.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An apparatus for stowing, launching and recovering an unmanned surface vehicle (USV) on a boat hull in water, said apparatus comprising:

a frame for removably attaching to the hull, said frame including parallel lateral rail brackets and associated upper and lower transverse braces, said lateral rail brackets providing upper and lower positions in relation to the hull, said transverse braces connecting to the hull;

a lift mechanism connecting to said frame along said lateral rail brackets for elevating the USV between said upper and lower positions;

a hinge directly connected to said lift mechanism;

a boom directly connected to said hinge, wherein said hinge pivots the boom between vertical and horizontal orientations for docking and releasing the USV, wherein the USV is stowed in said vertical orientation and said upper position, and the USV deploys into the water in said horizontal orientation and said lower position.

2. The apparatus according to claim 1, wherein said frame attaches to the hull at cushions.

3. The apparatus according to claim 1, wherein said lift mechanism ratchets along said lateral rail brackets for elevation of said hinge in relation to the hull.

4. The apparatus according to claim 1, wherein said hinge pivots said boom into said vertical orientation, and said lift mechanism elevates said hinge along said lateral rail brackets on said frame into said upper position.

5. The apparatus according to claim 1, wherein said transverse braces include an upper brace that connects inboard on the hull and a lower brace that connects to the hull below said lower position.

6. A method that enables automated launch and recovery for stowing, launching and recovering an unmanned surface vehicle (USV) on a boat hull in water, said method comprising:

equipping an apparatus for stowing, launching and recovering the USV on the hull, said apparatus including:

a frame for removably attaching to the hull, said frame including parallel lateral rail brackets and associated upper and lower transverse braces, said lateral rail brackets providing upper and lower positions relative to the hull, said transverse braces connecting to the hull;

a lift mechanism connecting to said frame along said lateral rail brackets for elevating the USV between said upper and lower positions on said frame;

a hinge directly connected to said lift mechanism;

a boom directly connected to said hinge, wherein said hinge pivots the boom between vertical and horizontal orientations for docking and releasing the USV;

maneuvering the USV to dock to said boom;

docking the USV to said boom;

rotating said boom by said hinge from said horizontal to vertical orientations;

raising said hinge from said lower to upper positions;

stowing the USV into said vertical, stowed position;

lowering said hinge by said lift mechanism from said upper to lower positions;

rotating said boom by said hinge from said vertical to horizontal orientations;

releasing the USV from said boom, wherein the USV is stowed in said vertical orientation and said upper position, and the USV deploys into the water in said horizontal orientation and said lower position.

7. The method according to claim 6, further including cushioning said frame for attaching to the hull.

8. The method according to claim 6, wherein said transverse braces include an upper brace that connects inboard on the hull and a lower brace that connects to the hull below said lower position.

* * * * *